US006922012B1

(12) United States Patent
Mashimo et al.

(10) Patent No.: US 6,922,012 B1
(45) Date of Patent: Jul. 26, 2005

(54) CATHODE-RAY TUBE WITH A REINFORCING BAND

(75) Inventors: Takuya Mashimo, Fukaya (JP); Norio Shimizu, Fukaya (JP); Masatsugu Inoue, Kumagaya (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/647,926

(22) PCT Filed: Feb. 15, 2000

(86) PCT No.: PCT/JP00/00820

§ 371 (c)(1),
(2), (4) Date: Jan. 30, 2001

(87) PCT Pub. No.: WO00/48222

PCT Pub. Date: Aug. 17, 2000

(30) Foreign Application Priority Data

Feb. 15, 1999 (JP) ..... 11-035764
Jan. 24, 2000 (JP) ..... 2000-014865

(51) Int. Cl.[7] ..... H01J 29/87

(52) U.S. Cl. ..... 313/477 R; 313/479; 313/408; 313/482; 220/2.1 A; 220/2.3 A; 348/821; 348/822; 348/836

(58) Field of Search ..... 313/477 R, 479, 313/482; 220/2.1 A, 2.3 A; 348/821, 822, 824, 825, 836

(56) References Cited

U.S. PATENT DOCUMENTS

| | | | | |
|---|---|---|---|---|
| 3,593,874 A | | 7/1971 | Powell | 220/2.1 A |
| 4,121,257 A | | 10/1978 | Krishnamurthy | 358/246 |
| 4,168,010 A | | 9/1979 | Dougherty | 220/2.1 A |
| 5,216,513 A | | 6/1993 | Swank | 358/246 |
| 5,270,826 A | | 12/1993 | Fowler | 358/246 |
| 5,743,778 A | * | 4/1998 | Arimoto et al. | 445/8 |
| 6,342,760 B1 | * | 1/2002 | Mashimo et al. | 313/477 R |
| 6,353,283 B1 | * | 3/2002 | Ghosh et al. | 313/477 R |
| 6,501,215 B1 | * | 12/2002 | Kim | 313/477 R |
| 6,509,683 B2 | * | 1/2003 | Lee | 313/477 R |
| 6,534,909 B1 | * | 3/2003 | Kim | 313/482 |
| 6,590,331 B1 | * | 7/2003 | Soneda et al. | 313/477 R |

FOREIGN PATENT DOCUMENTS

| | | |
|---|---|---|
| EP | 0 626 717 | 11/1994 |
| EP | 0 740 326 | 10/1996 |
| JP | 60-44948 | 3/1985 |
| JP | 60-175348 | 9/1985 |
| JP | 1-149344 | 6/1989 |
| JP | 5-144387 | 6/1993 |
| JP | 10-308188 | 11/1998 |

OTHER PUBLICATIONS

Patent Abstracts of Japan, vol. 010, No. 011 (E–374), Jan. 17, 1986, JP 60 175348, Sep. 9, 1994.
Patent Abstracts of Japan, vol. 013, No. 407 (E–818), Sep. 8, 1989, JP 01 149344, Jun. 12, 1989.

* cited by examiner

*Primary Examiner*—Joseph Williams
*Assistant Examiner*—Sikha Roy
(74) *Attorney, Agent, or Firm*—Oblon, Spivak, McClelland, Maier & Neustadt, P.C.

(57) ABSTRACT

A panel (2) of a vacuum envelope includes a substantially rectangular effective portion (8) having a substantially flat outer surface and also having a phosphor screen 1 formed on an inner surface, and a skirt portion (9) provided along a peripheral part of the effective portion and extended substantially perpendicularly to the effective portion. A funnel (3) is bonded to the skirt portion. A reinforcing band for fastening the skirt portion is attached round an outer surface of the skirt portion. When a distance in a direction of the tube axis from a bonding part between the panel and the funnel to an end of the reinforcing band on the outer surface side of the effective portion is represented by a and a distance in the direction of the tube axis from the bonding part to a central position of the outer surface of the effective portion is represented by h, the reinforcing band is arranged to satisfy a $\geqq 0.9h$.

8 Claims, 2 Drawing Sheets

CATHODE-RAY TUBE WITH A REINFORCING BAND

TECHNICAL FIELD

The present invention relates to a cathode-ray tube having a reinforcing band for improvement of implosion-proof characteristics.

BACKGROUND ART

Generally, a color cathode-ray tube comprises a vacuum envelope formed of glass. The vacuum envelope has a substantially rectangular panel and a funnel bonded to the panel. The panel integrally has a substantially rectangular effective portion and a frame-like skirt portion provided along the periphery of the effective portion and extended substantially perpendicularly to the effective portion. A phosphor screen including three-color phosphor layers for emitting lights of blue, green and red is formed on the inner surface of the effective portion.

A shadow mask having a number of electron beam passage apertures is arranged to face the phosphor screen, inside the vacuum envelope, and an electron gun for emitting three electron beams onto the phosphor screen is mounted in a neck of the funnel.

In the above-constituted color cathode-ray tube, three electron beams emitted from the electron gun are deflected by use of a deflection yoke mounted on the outer side of the funnel, and scan the phosphor screen horizontally and vertically via the electron beam passage apertures, thereby displaying color images.

In a conventional color cathode-ray tube, the compressive stress is applied to the vacuum envelope by fastening the skirt portion of the panel by a reinforcing band, to improve the implosion-proof characteristics of the vacuum envelope.

The effective portion of the panel has a large curvature, in the conventional color cathode-ray tube. For this reason, even if the fastening position of the reinforcing band is set near center of the skirt portion with respect to the direction of tube axis, the outward force generated at the effective portion of the panel by the fastening of the reinforcing band is substantially uniform on the overall surface of the effective portion. Thus, the stable implosion-proof characteristics can be achieved.

On the other hand, recently, a request to flatten the outer surface of the effective portion of the color cathode-ray tube has been increased for easy view of images.

In the conventional structure, however, problems will arise in relation to the implosion-proof characteristics when the effective portion is flattened. That is, if the outer surface of the effective portion of the panel is flat or has a small curvature, the outward force generated at the effective portion of the panel by the fastening of the reinforcing band is extremely large at corners of the effective portion, in the structure of fastening the vicinity of the center of the skirt portion in the direction of tube axis by the reinforcing band as seen in the prior art. For this reason, when the vacuum envelope is broken, the glass at the corners of the effective portion easily flies, which worsens the implosion-proof characteristics.

Further, the deformation of the effective portion caused by the fastening of the reinforcing band is large. For this reason, when the compressive stress applying to the effective portion is irregular, the irregularity in the deformation of the effective portion becomes larger. In accordance with this, the phosphor screen is also deformed and therefore the phosphor layers are shifted from their initial position. As a result, the landing positions of the electron beams become irregular and the quality of images is deteriorated.

DISCLOSURE OF INVENTION

The present invention is accomplished in consideration of the above circumstances, and its object is to provide a color cathode-ray tube capable of reducing the irregularity of the beam landing and improving the implosion-proof characteristics.

To achieve the above object, a color cathode-ray tube according to the present invention comprises: a vacuum envelope including a panel which has a substantially rectangular effective portion having a substantially flat outer surface and having a phosphor screen formed on an inner surface and which has a skirt portion provided along a peripheral part of the effective portion and extended substantially perpendicularly to the effective portion, and a funnel bonded to the skirt portion; an electron gun arranged in a neck of the funnel, for emitting electron beams onto the phosphor screen; and a reinforcing band attached round an outer surface of the panel, for fastening the skirt portion, wherein the reinforcing band is attached to the skirt portion at a position closer to an outer surface side of the effective portion than to a central portion of the skirt portion, in a direction of tube axis of the vacuum envelope.

According to the above-constituted cathode-ray tube, the attachment position of the reinforcing band is near the panel effective portion outer surface in the direction of the tube axis. Therefore, the compressive stress caused by the reinforcing band is easily applied to the effective portion of the panel and thus the external force at the effective portion is reduced. Thus, flying of glass constituting the panel can be reduced and the implosion-proof characteristics can be thereby improved, on the effective portion of the panel. Further, deformation of the panel effective portion caused by the compressive stress of the reinforcing band can be reduced and the irregularity in the landing positions of the electron beams can be thereby restricted.

In addition, according to another cathode-ray tube of the present invention, when a distance in a direction of the tube axis from a bonding part of the panel and the funnel to an end of the reinforcing band on the outer surface side of the effective portion is represented by $\underline{a}$ and a distance in the direction of the tube axis from the bonding part to a central position of the outer surface of the effective portion is represented by $\underline{h}$, the reinforcing band is arranged to have the relationship $a \geqq 0.9h$.

According to the above structure, the compressive stress caused by the reinforcing band is easily applied to the effective portion of the panel and the external force at the effective portion can be reduced, and the flying of the glass can be reduced and the implosion-proof characteristics can be thereby improved. Further, the deformation of the panel effective portion caused by the compressive stress of the reinforcing band can be reduced and the irregularity in the beam landing positions can be thereby restricted.

In addition, according to the cathode-ray tube of the present invention, the reinforcing band has a bent portion formed by folding outwardly the end part of the reinforcing band on the outer surface side of the effective portion. When a distance in the direction of the tube axis from the bonding part of the panel and the funnel to an end of the bent portion on the electron gun side is represented by $\underline{b}$ and the distance in the direction of the tube axis from the bonding part to a central position of the outer surface of the effective portion is represented by h, the reinforcing band is arranged to have the relationship b≧0.7h.

Thus, by restricting the size of the bent portion of the reinforcing band to be b≧0.7h, the compressive stress can be improved near the only effective portion of the panel, even in the fastening range of the reinforcing band, and thereby the implosion-proof characteristics can be improved and the irregularity in the beam landing positions can be restricted.

Further, according to the other cathode-ray tube of the present invention, when a distance in the direction of the tube axis from the bonding part of the panel and the funnel to a mold matching line of the panel is represented by c and the distance in the direction of the tube axis from the bonding part to a central position of the outer surface of the effective portion is represented by h, the panel is arranged to have the relationship c≧0.8h. The reinforcing band is attached round the skirt portion over the mold matching line.

According to this invention, the position of the panel mold matching line, where the compressive stress caused by the reinforcing band becomes maximum, is set to be c≧0.8h and to be close to the outer surface side of the effective portion of the panel. Therefore, the compressive stress in the vicinity of the effective portion of the panel can be improved, the flying of the glass can be reduced and the implosion-proof characteristics can be thereby improved. Further, the deformation of the panel effective portion caused by the compressive stress of the reinforcing band can be reduced and the irregularity in the beam landing positions can be thereby restricted.

According to the other cathode-ray tube of the present invention, the reinforcing band and the panel have the relationships of a≧0.9h, b≧0.7h, and c≧0.8h, and the reinforcing band is attached round the skirt portion over the mold matching line.

According to the further cathode-ray tube of the present invention, the reinforcing band is attached over the mold matching line of the panel and the panel has a part where an angle θ defined between the outer surface of the skirt portion from the mold matching line of the panel to the effective portion outer surface and the direction of the tube axis is zero.

According to the above cathode-ray tube, the angle θ is zero, only at each of corners of the panel.

According to the above-constituted cathode-ray tube, the compressive stress caused by the reinforcing band is largely applied from the mold matching line of the panel to the skirt portion of the effective portion outer surface side. Therefore, the flying of the glass can be reduced and the implosion-proof characteristics can be improved. In addition, the deformation of the panel effective portion can be reduced and the irregularity in the beam landing positions can be restricted.

Moreover, according to the other cathode-ray tube of the present invention, when the thickness of the effective portion at an outer peripheral position of the phosphor screen is represented by t and the thickness of the effective portion at a central position of the phosphor screen is represented by tc, the effective portion has a portion which satisfies the relationship of t≧1.5tc.

Thus, the advantages achieved by satisfying the other conditions described above can be made further larger, by limiting the thickness of the effective portion.

A cathode-ray tube satisfying all the above-described conditions a≧0.9h, b≧0.7h, c≧0.8h, θ=0, and t≧1.5tc may be constituted. In this case, the compressive stress in the vicinity of the panel effective portion can be certainly made larger, and the implosion-proof characteristics can be improved and the irregularity in the beam landing positions can be reduced.

BEST MODE OF CARRYING OUT THE INVENTION

A color cathode-ray tube according to an embodiment of the present invention will be explained in detail with reference to the accompanying drawings.

Figure 1:
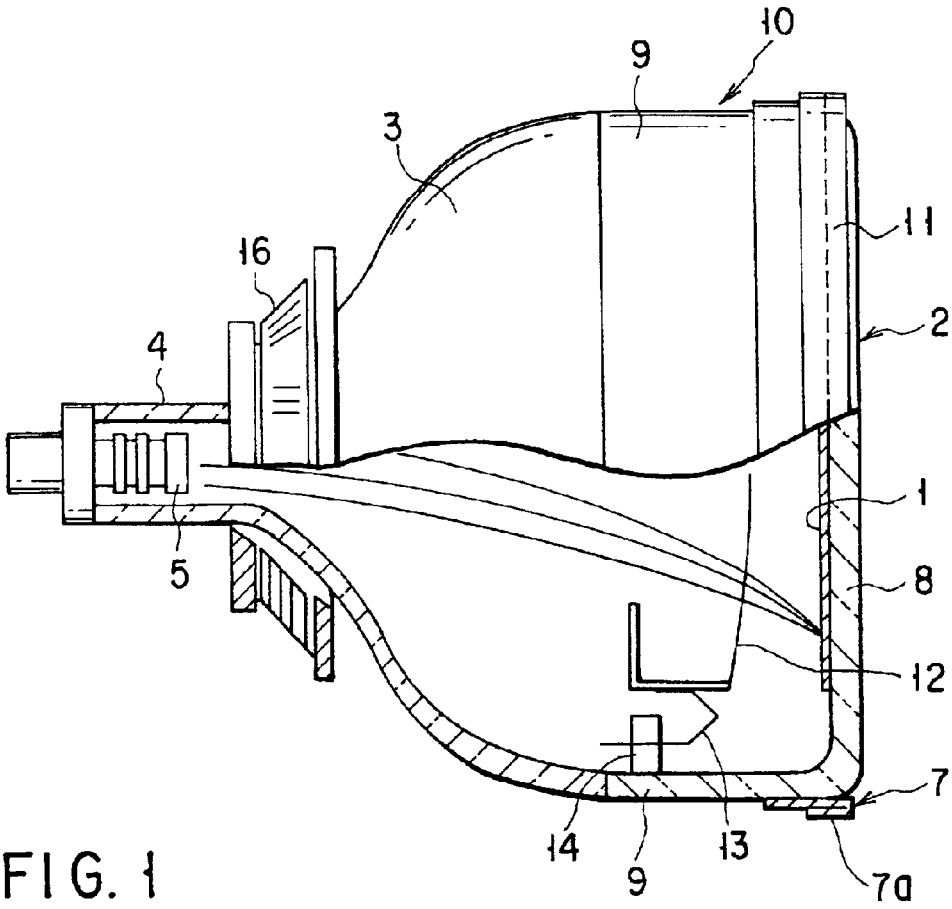
FIG. 1 is a partially cutaway, plan view showing a color cathode-ray tube according to an embodiment of the present invention.
Figure 2:
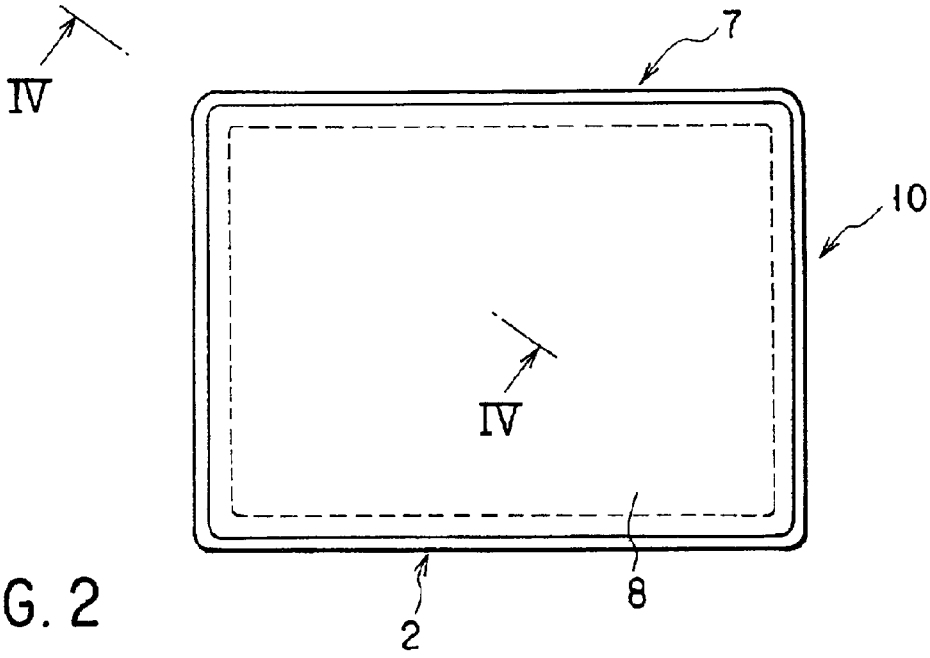
FIG. 2 is a front view showing a panel of the color cathode-ray tube.

The color cathode-ray tube comprises a vacuum envelope 10 formed of glass, and the vacuum envelope includes a substantially rectangular panel 2 and a funnel 3 bonded to the panel, as shown in FIGS. 1 and 2. The panel 2 has a substantially rectangular effective portion 8 and a frame-like skirt portion 9 provided along a periphery of the effective portion to extend substantially perpendicularly to the effective portion, as one body. An outer surface of the effective portion 8 is formed to be substantially flat or to have a small curvature. A phosphor screen 1 having three-color phosphor layers for emitting light beams of blue, green and red is formed on an inner surface of the effective portion 8. The funnel 3 is bonded on an end surface of the skirt portion 9.

A shadow mask 12 having a number of electron beam passage apertures is arranged so as to face the phosphor screen 1 inside the vacuum envelope 10. An electron gun 5 for emitting three electron beams toward the phosphor screen 1 is arranged inside a neck 4 of the funnel 3. Engaging pins 14 protrude from plural parts of the inner surface of the skirt portion 9, and the shadow mask 12 is supported within the vacuum envelope 10 by engaging elastic support members 13 attached to the shadow mask with the respective engaging pins 14.

With the color cathode-ray tube having the above structure, a color image is displayed by deflecting the three electron beams emitted from the electron gun 5 by use of a deflection yoke 16 mounted on the outer surface of the funnel 3 and by scanning the phosphor screen 1 horizontally and vertically via the electron beam passage apertures of the shadow mask 12.

A reinforcing band 7 for fastening the skirt portion 9 is attached around the entire periphery of the outer surface of the skirt portion 9 of the panel 2. The reinforcing band 7 is formed of an alloy in a substantially rectangular shape corresponding to the outer shape of the skirt portion 9. The end portion of the reinforcing band 7, on the outer surface side of the effective portion 8, is bent outwardly at 180 degrees to form a bent portion 7*a*, as shown in FIG. 3.

According to the present embodiment, to reduce the outward force generated at the corners of the effective portion 8 of the panel 2 by the fastening of the reinforcing band 7, the reinforcing band 7 is mounted to be closer to the vicinity of the outer surface of the effective portion 8 than to the vicinity of the center of the skirt portion 9, in the tube axis direction of the vacuum envelope 10, so that the compressive stress caused by the reinforcing band 7 can be further applied to the effective portion 8.

Figure 3:
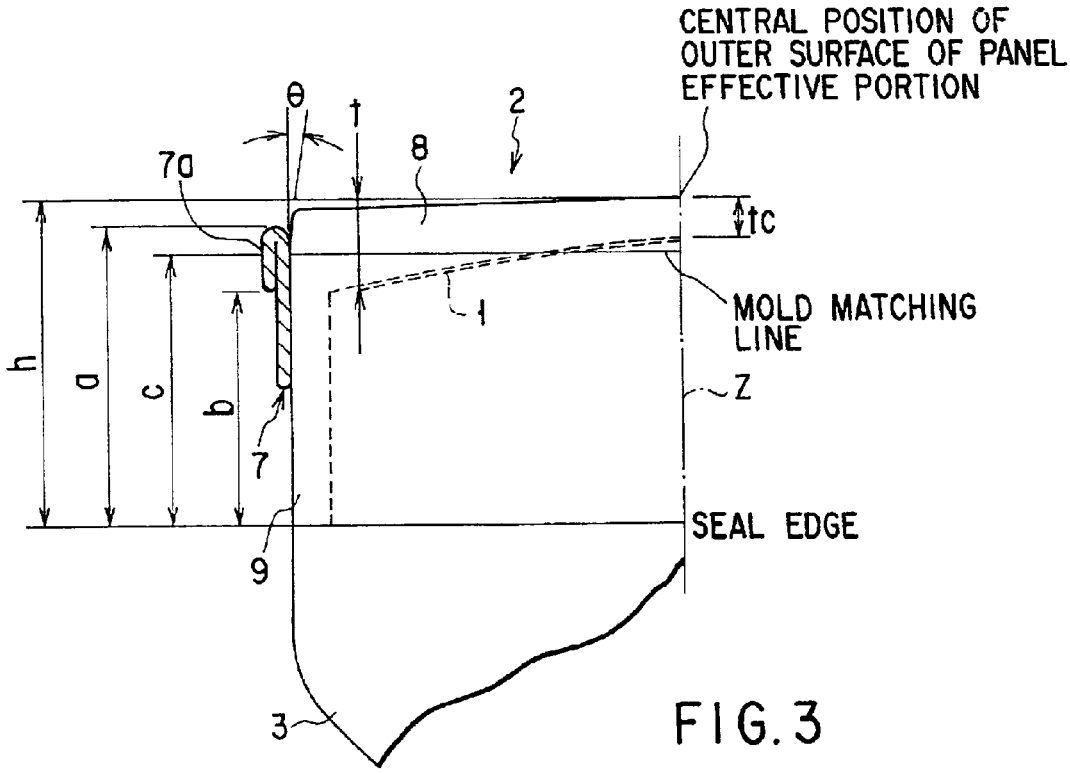
FIG. 3 is a diagram schematically showing the panel and a reinforcing band to explain structural parameters a, b, c, θ, t, and tc of the color cathode-ray tube.

To explain in detail, if the distance in the direction of the tube axis Z from a bonding portion (a seal edge) between the panel 2 and the funnel 3 to the end of the reinforcing band 7 on the outer surface side of the effective portion 8 is represented by a and if the distance in the direction of the tube axis Z from the seal edge to the center of the outer surface of the effective portion 8 of the panel 2 is represented by h, as shown in FIG. 3, the reinforcing band 7 is mounted at a position satisfying the following relationship $$a \geqq 0.9h$$

The size of the bent portion 7*a* on the effective portion 8 side of the reinforcing band 7 is restricted in order to increase the compressive stress in the only area near the effective portion 8, within the fastening area of the reinforcing band 7. That is, if the distance in the direction of the tube axis Z from the seal edge to the end of the bent portion 7*a* on the electron gun 5 side is represented by b, the reinforcing band 7 is formed to satisfy the following relationship $$b \geqq 0.7h$$

The part of a mold matching line 11 of the panel 2, where the compressive stress applied by the reinforcing band 7 is made largest, is positioned to be close to the outer surface of the effective portion 8 of the panel 2. If the distance in the direction of the tube axis Z from the seal edge between the panel 2 and the funnel 3 to the mold matching line 11 is represented by c, the mold matching line 11 is formed to satisfy the following relationship $$c \geqq 0.8h$$

Figure 4:
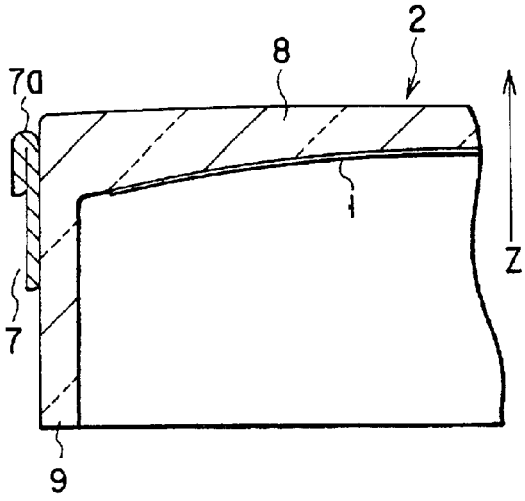
FIG. 4 is a sectional view showing the panel as seen along a line IV—IV of FIG. 2.

The outer surface of the part from the mold matching line 11 to the outer surface of the effective portion 8, in the outer surface of the skirt portion 9 of the panel 2, makes an angle θ (0 to 3 degrees) in the direction of the tube axis Z. To apply the compressive stress caused by the reinforcing band 7 more largely to the corners of the effective portion 8 of the panel 2, however, a part of the outer surface of the panel 2, i.e. each corner of the panel is formed such that the angle θ made by both the outer surface of the skirt portion 9 and the direction of the tube axis Z is zero degree in the area from the mold matching line 11 to the outer surface of the effective portion 8, as shown in FIG. 4. Therefore, at each corner of the panel 2, the area from the mold matching line 11 to the outer surface of the effective portion 8 also abuts on the reinforcing band 7. As a result, the compressive stress is applied to the area at each corner of the skirt portion 9.

As described above, the compressive stress caused by the fastening of the reinforcing band 7 can easily be applied to the effective portion 8 of the panel 2 and the outward force in the effective portion 8 can be reduced by setting the conditions of $a \geqq 0.9h$, $b \geqq 0.7h$, $c \geqq 0.8h$ and $\theta = 0$ degree.

Thus, when the vacuum envelope 10 is broken, flying of glass pieces outwardly from the effective portion 8 can be reduced and implosion-proof characteristics of the color cathode-ray tube can be improved. At the same time, deformation of the effective portion 8 which results from the compressive stress caused by the fastening of the reinforcing band 7 can be reduced and irregularity in the landing positions of the electron beams can be also reduced.

Next, the specific examples of the present invention will be explained.

Six kinds of color cathode-ray tubes (CRT) (1) to (6) different in the above-mentioned structural parameters a, b, c and θ as represented in the following TABLE 1 were used by use of a color cathode-ray tube in which a radius of curvature on the outer surface of the effective portion 8 of the panel 2 was about 10 m, to execute an implosion test.

Figure 5:
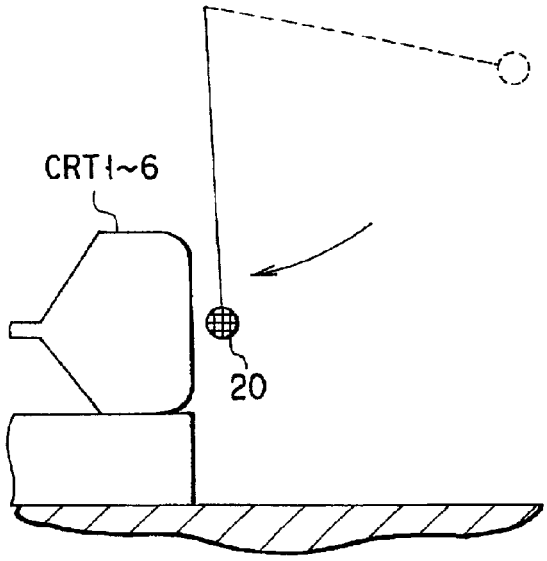
FIG. 5 is a diagram schematically showing the ball impact method.

Employing the ball impact method and the missile impact method, the implosion test was executed under the UL standards, which are the most strict safety standards in the U.S.A. As shown in FIG. 5, the test method was making a predetermined steel ball 20 or a steel missile collide with a predetermined area of the effective portion of the panel on each of the CRTs (1) to (6) by adoption of the principle of the pendulum and applying a predetermined impact thereto, and measuring the weight of glass pieces flying in front of the effective portion and the distance of flying. Thus, the test results represented in TABLE 1 were obtained.

TABLE 1

| | h [mm] | a [mm] | b [mm] | c [mm] | θ [deg] (CORNER) | TEST RESULTS |
|---|---|---|---|---|---|---|
| CRT1 | 115 | 107 (0.930 h) | 87 (0.757 h) | 95 (0.826 h) | 0.0 | ◎ |
| CRT2 | 125 | 117 (0.936 h) | 82 (0.656 h) | 101 (0.808 h) | 2.0 | ○ |
| CRT3 | 125 | 115 (0.920 h) | 80 (0.640 h) | 99 (0.792 h) | 2.0 | Δ+ |
| CRT4 | 100 | 90 (0.900 h) | 70 (0.700 h) | 77 (0.770 h) | 3.0 | Δ− |
| CRT5 | 115 | 103 (0.896 h) | 73 (0.635 h) | 90 (0.783 h) | 3.0 | X |
| CRT6 | 115 | 98.5 (0.857 h) | 78.5 (0.683 h) | 90 (0.783 h) | 3.0 | X |

As evident from the test results of TABLE 1, as for the CRTs (4) to (6), flying of the peeled pieces was very large and satisfying the UL standards was difficult. As for the CRT (3), the weight of the flying peeled pieces was small and the distance of flying was short, but the UL standards were slightly satisfied.

As for the CRT (2), flying of the peeled pieces satisfied the UL standards without problems. In the case of the CRT (1), the UL standards were satisfied and even a small implosion did not almost occur probabilistically, and as a result, very stable implosion-proof characteristics were obtained.

Therefore, it can be understood that flying of the glass from the effective portion 8 can be reduced and the implosion-proof characteristics can be improved by setting under the above-mentioned conditions of the present embodiment the structural parameters to be:

$a \geqq 0.9h$ $b \geqq 0.7h$ $c \geqq 0.8h$ $\theta = 0$ (at the corners)

and by further applying the compressive stress caused by the fastening of the reinforcing band 7 onto the effective portion 8 side of the panel 2. In addition, by setting the above-mentioned conditions, the deformation of the effective portion 8 resulting from the compressive stress caused by the fastening of the reinforcing band 7 can be reduced, and the irregularity in the beam landing positions associated with the irregularity in the compressive stress caused by the fastening of the reinforcing band 7 can be also reduced.

Next, the differences in the advantages of the respective conditions corresponding to thickness t were tested where the maximum thickness of the effective portion 8 located at the outer periphery of the phosphor screen 1 is represented by t and the thickness of the effective portion 8 located at the center of the phosphor screen 1 is represented by tc, as shown in FIG. 3. Three kinds of color cathode-ray tubes (7) to (9) different in the thickness t were prepared and the implosion test was executed in the same manner as the above-described one. The relationship between the thicknesses t and tc, and the test results as obtained at this time are represented below in TABLE 2.

TABLE 2

| | t | TEST RESULTS |
|---|---|---|
| CRT7 | 1.8tc | Δ+ |
| CRT8 | 1.9tc | ○ |
| CRT9 | 2.2tc | ◎ |

As understood from the TABLE 2, as the thickness t of the effective portion 8 at the periphery of the phosphor screen 1 is larger than the thickness t of the effective portion 8 at the center of the phosphor screen 1, the advantages obtained when the above conditions are satisfied become larger and the implosion-proof characteristics become more stable. Therefore, it is preferable that the effective portion 8 should be formed to satisfy the relationship $t \geqq 1.5tc.$ The present invention is not limited to the above-described embodiment, and can be variously modified within the inventive scope of the present invention. For example, the present invention cannot be applied only to a color cathode-ray tube, but also to a monochromatic cathode-ray tube.

Industrial Applicability

The present invention can provide a cathode-ray tube having the outer surface of the panel effective portion formed to be substantially flat, wherein flying of the glass pieces from the panel effective portion can be reduced and the implosion-proof characteristics can be improved, the deformation of the panel effective portion resulting from the fastening of the reinforcing band can be reduced, and the irregularity in the beam landing positions can be also reduced, by arranging the reinforcing band so as to allow the compressive stress caused by the reinforcing band to be applied onto the panel effective portion side.

The present invention can also provide a cathode-ray tube wherein flying of the glass pieces from the panel effective portion can be reduced and the implosion-proof characteristics can be improved, the deformation of the panel effective portion resulting from the fastening of the reinforcing band can be reduced, and the irregularity in the beam landing can be also reduced, by setting the structural parameters a, b, c and θ at appropriate values.

What is claimed is:

1. A cathode ray tube comprising:

a vacuum envelope including a panel which has a substantially rectangular effective portion having a substantially flat outer surface and having a phosphor screen formed on an inner surface and which has a skirt portion provided along a peripheral part of the effective portion and extending substantially perpendicular to the effective portion, and a funnel bonded to the skirt portion;

an electron gun arranged in a neck of the funnel, for emitting electron beams onto the phosphor screen; and a reinforcing band attached round an outer surface of the panel, for fastening the skirt portion, the reinforcing band has a bent portion formed by folding outwardly the end portion of the reinforcing band on the effective portion outer surface side, wherein when a distance in a direction of the tube axis from a bonding part of the panel and the funnel to an end of the reinforcing band on the outer surface side of the effective portion is represented by a, a distance in the direction of the tube axis from the bonding part of the panel and the funnel to an end of the bent portion on the electron gun side is represented by b, and a distance in the direction of the tube axis from the bonding part to a central position of the outer surface of the effective portion is represented by h, the reinforcing band is arranged to satisfy the following relationship:

$a \geqq 0.9h,\ b \geqq 0.7h.$

2. A cathode-ray tube according to claim 1, wherein when a thickness of the effective portion at an outer peripheral position of the phosphor screen is represented by t and a thickness of the effective portion at a central position of the phosphor screen is represented by tc, the effective portion has a portion which satisfies the following relationship:

$t \geqq 1.5tc.$

3. A cathode-ray tube comprising:

a vacuum envelope including a panel which has a substantially rectangular effective portion having a substantially flat outer surface and having a phosphor screen formed on an inner surface and which has a skirt portion provided along a peripheral part of the effective portion and extending substantially perpendicular to the effective portion, and a funnel bonded to the skirt portion;

an electron gun arranged in a neck of the funnel, for emitting electron beams onto the phosphor screen; and a reinforcing band attached round an outer surface of the panel, for fastening the skirt portion, wherein when a distance in the direction of a tube axis from the bonding part of the panel and the funnel to a mold matching line of the panel is represented by c and a distance in the direction of the tube axis from the bonding part to a central position of the outer surface of the effective portion is represented by h, the panel is arranged to satisfy the following relationship:

$$c \geqq 0.8h$$

and, the reinforcing band is attached round the skirt portion over the mold matching line.

4. A cathode-ray tube comprising:

a vacuum envelope including a panel which has a substantially rectangular effective portion having a substantially flat outer surface and having a phosphor screen formed on an inner surface and which has a skirt portion provided along a peripheral part of the effective portion and extending substantially perpendicular to the effective portion, and a funnel bonded to the skirt portion;

an electron gun arranged in a neck of the funnel, for emitting electron beams onto the phosphor screen; and a reinforcing band attached round an outer surface of the panel, for fastening the skirt portion, wherein the reinforcing band has a bent portion formed by folding outwardly the end portion of the reinforcing band on the outer surface side of the effective portion;

when a distance in a direction of the tube axis from a bonding part of the panel and the funnel of an end of the reinforcing band on the outer surface side of the effective portion is represented by a, when a distance in the direction of the tube axis from the bonding part of the panel and the funnel to the end of the bent portion on the electron gun side is represented by b, when a distance in the direction of the tube axis from the bonding part of the panel and the funnel to a mold matching line of the panel is represented by c and when a distance in the direction of the tube axis from the bonding part to a central position of the outer surface of the effective portion is represented by h, the reinforcing band and the panel are arranged to satisfy the following relationships:

$$a \geqq 0.9,\ b \geqq 0.7h,\ c \geqq 0.8h$$

and, the reinforcing band is attached round the skirt portion over the mold matching line.

5. A cathode-ray tube according to claim 4, wherein when a thickness of the effective portion at an outer position of the phosphor screen is represented by t and a thickness of the effective portion at a central position of the phosphor screen is represented by tc, the effective portion has a portion which satisfies the following relationship:

$$t \geqq 1.5tc.$$

6. A cathode-ray tube comprising:

a vacuum envelope including a panel which has a substantially rectangular effective portion having a substantially flat outer surface and having a phosphor screen formed on an inner surface and which has a skirt portion provided along a peripheral part of the effective portion and extending substantially perpendicular to the effective portion, and a funnel bonded to the skirt portion;

an electron gun arranged in a neck of the funnel, for emitting electron beams onto the phosphor screen; and a reinforcing band attached round an outer surface of the panel, for fastening the skirt portion, wherein the reinforcing band is attached round the skirt portion over the mold matching line and has a bent portion formed by folding outwardly the end portion of the reinforcing band on the outer surface side of the effective portion;

the panel has a part where an angle θ defined between the outer surface of the skirt portion from the mold matching line of the panel to the outer surface of the effective portion and a direction of the tube axis is zero; and when a distance in a direction of the tube axis from a bonding part of the panel and the funnel to an end of the reinforcing band on the outer surface side of the effective portion is represented by a, when a distance in the direction of the tube axis from the bonding part of the panel and the funnel to an end of the bent portion on the electron gun side is represented by b, when a distance in the direction of the tube axis from the bonding part of the panel and the funnel to the mold matching line of the panel is represented by c and when a distance in the direction of the tube axis from the bonding part to a central position of the outer surface of the effective portion is represented by h, the reinforcing band and the panel are arranged to satisfy the following relationships:

$$a \geqq 0.9h,\ b \geqq 0.7h,\ c \geqq 0.8h.$$

7. A cathode-ray tube according to claim 6, wherein the angle θ is zero, only at each of corners of the panel.

8. A cathode-ray tube according to claim 6, wherein when a thickness of the effective portion at an outer peripheral position of the phosphor screen is represented by t and a thickness of the effective portion at a central position of the phosphor screen is represented by tc, the effective portion has a portion which satisfies the following relationship:

$$t \geqq 1.5tc.$$

* * * * *

UNITED STATES PATENT AND TRADEMARK OFFICE

CERTIFICATE OF CORRECTION

PATENT NO. : 6,922,012 B1
APPLICATION NO. : 09/647926
DATED : July 26, 2005
INVENTOR(S) : Mashimo et al.

It is certified that error appears in the above-identified patent and that said Letters Patent is hereby corrected as shown below:

On the title page, Item (86), the PCT information is incorrect. Item (86) should read:
-- (86) PCT No.: PCT/JP00/00820

§ 371 (c) (1),
(2), (4) Date: Oct. 16, 2000 --

Signed and Sealed this

Second Day of October, 2007

JON W. DUDAS
*Director of the United States Patent and Trademark Office*